US006052930A

United States Patent [19]

Hermanson et al.

[11] Patent Number: 6,052,930

[45] Date of Patent: Apr. 25, 2000

[54] ORNAMENTAL DISPLAY GLOBE

[75] Inventors: Terry Hermanson, New York, N.Y.; Huang Meng-Suen, Kowloon, The Hong Kong Special Administrative Region of the People's Republic of China

[73] Assignee: Mr. Christmas, Inc., New York, N.Y.

[21] Appl. No.: 09/112,474

[22] Filed: Jul. 9, 1998

[51] Int. Cl.[7] ..... G09F 19/00

[52] U.S. Cl. ..... 40/410; 40/414; 40/430; 40/473; 446/267; 446/236

[58] Field of Search ..... 40/410, 426, 427, 40/406, 409, 414, 430, 473; 446/129, 133, 134, 135, 136, 267, 236

[56] References Cited

U.S. PATENT DOCUMENTS

| | | | |
|---|---|---|---|
| 909,467 | 1/1909 | Shaw . | |
| 1,396,902 | 11/1921 | Wainola . | |
| 2,361,423 | 10/1944 | Snyder | 41/10 |
| 2,528,968 | 11/1950 | Nelson et al. | 40/126 |
| 3,535,805 | 10/1970 | Peiperl | 40/106.21 |
| 4,521,982 | 6/1985 | Altuchow | 40/407 |
| 4,817,311 | 4/1989 | Ong | 40/410 |
| 4,852,283 | 8/1989 | Teng | 40/426 |
| 4,961,276 | 10/1990 | Lin | 40/410 |
| 5,092,065 | 3/1992 | Teng | 40/410 |
| 5,105,343 | 4/1992 | Wakimoto | 362/101 |
| 5,110,636 | 5/1992 | Hou | 428/11 |
| 5,258,209 | 11/1993 | Bankert et al. | 428/11 |
| 5,286,535 | 2/1994 | Hou | 446/267 X |
| 5,374,216 | 12/1994 | Jung et al. | 446/175 |
| 5,406,728 | 4/1995 | Willitts, Jr. | 40/409 |
| 5,416,995 | 5/1995 | Teng | 40/419 |
| 5,442,869 | 8/1995 | McDarren et al. | 40/406 |
| 5,620,353 | 4/1997 | Lai | 40/410 X |
| 5,675,921 | 10/1997 | Lin | 40/409 |
| 5,705,759 | 1/1998 | DeVivo | 40/410 X |
| 5,775,014 | 7/1998 | Lin | 40/406 |
| 5,864,976 | 2/1999 | Yang | 40/410 |
| 5,878,515 | 3/1999 | Yang | 40/410 X |

*Primary Examiner*—Terry Lee Melius
*Assistant Examiner*—Rodrigo J. Morales
*Attorney, Agent, or Firm*—Fitzpatrick, Cella, Harper & Scinto

[57] ABSTRACT

An ornamental display globe includes a transparent hollow sphere filled with a transparent liquid and a figurine disposed inside the sphere. The figurine is maintained in a preferred orientation in the transparent liquid when the transparent hollow sphere is subjected to movement.

18 Claims, 6 Drawing Sheets

ORNAMENTAL DISPLAY GLOBE

BACKGROUND OF THE INVENTION

1. Field of the Invention

The present invention relates to an ornamental display in which one or more figurines are disposed inside of a display container, such as a globe, and which is filled with a transparent liquid. Also disposed inside the display globe is particulate matter that becomes suspended in the liquid when the display globe is agitated so as to simulate falling snow or the like.

2. Description of the Related Art

Typically, conventional ornamental displays, such as display globes, include a base onto which a figurine or other display is fixed. Also fixed to the base is a dome that may, for example, be hemispherical in shape. The seal between the base and the dome is water tight so that the interior of the display globe may be filled with water or other suitable liquid. Also sealed within the dome is particulate matter. When the display globe is shaken or otherwise agitated, the particulate matter becomes randomly and temporarily suspended in the liquid to simulate a snow scene or the like. Once the agitation has stopped, the particulate matter settles to the base of the display globe. One example of such a conventional display globe is disclosed in U.S. Pat. No. 5,258,209. In that patent, a decorative display globe in the shape of a bell has figurines of a house, trees, and the like fixed to a base of the device. By grasping the handle of the display device and shaking it, the particulate matter becomes randomly and temporarily suspended in the liquid sealed in the decorative display to simulate a snow scene. Other conventional display globes provide a mechanical device, such as a motor, for agitating the liquid so that the snow scene is simulated as long as the motor is activated. One example of such a device is disclosed in U.S. Pat. No. 4,817,311.

Rather than fixing a figurine to the base of an ornamental display, the figurine may be fixed to the display globe itself via a shaft as disclosed in U.S. Pat. Nos. 5,092,065 and 1,396,902, for example. It is also known to provide a figurine inside the display globe without fixing the figurine either to the base of the ornamental display or to the globe itself. For example, in U.S. Pat. No. 909,467, a display globe is partially filled with liquid and figurines are floated on the surface of the liquid. The figurines disclosed in this patent may have a weighted keel to keep them floating in an upright position. In U.S. Pat. No. 1,396,902, the figurines have a hemispherical base and are weighted so as to maintain an upright position, and to maintain a single point of contact with the interior wall of tile receptacle in which they are displayed.

It is desirable, however, to provide an ornamental display featuring figurines or other types of scenery within a globe substantially completely filled with liquid, and that maintain their position even when the globe is moved or otherwise agitated to suspend particulate matter within the globe to simulate a snow scene or the like.

SUMMARY OF THE INVENTION

Accordingly, it is a principal object of the present invention to provide an ornamental display, such as a globe, in which figurines are disposed within a transparent liquid inside the display globe and substantially fixed with respect to an inertial reference frame.

These and other objects are achieved by the present invention which, in one aspect, relates to an ornamental display including a transparent hollow receptacle filled with a transparent liquid, and at least one figurine disposed in the transparent liquid inside the transparent hollow receptacle so as to have a preferred orientation when the transparent hollow receptacle is subjected to movement.

The display may additionally include a support structure for supporting the transparent hollow receptacle, a displacing mechanism for returnably displacing the transparent hollow receptacle from the support structure, and connecting structure for connecting the transparent hollow sphere to the displacing mechanism.

In another aspect of the invention, a transparent hollow receptacle, such as a globe, is subjected to rotational movement about an axis, such as a horizontal or a vertical axis, as the figurine in the transparent liquid remains in its preferred orientation during the rotational movement. To provide the rotational movement, the display includes a support structure for supporting the globe, a drive mechanism for supplying a driving force to drive the globe about an axis of the support structure, and a connecting structure for connecting the globe to the drive mechanism.

In still another aspect of the invention, there is provided an ornamental display including a transparent hollow receptacle containing a transparent liquid, and a substantially neutrally buoyant figurine disposed inside the transparent hollow receptacle, with the figurine weighted to have a preferred orientation.

In another aspect of the invention, the ornamental display includes a base for supporting the transparent hollow receptacle, and the buoyant figurine inside the transparent hollow receptacle and the base include magnets for maintaining the figurine in its preferred orientation.

In yet another aspect of the invention, the display globe is supported on a base and rotatable about an axis, and the figurines or scenery inside the display globe are fixed to the base so as to remain substantially stationary as the display globe rotates.

These and other aspects, objects, and features of the present invention will become apparent from the following detailed description of the preferred embodiments of the present invention, read in conjunction with reference to the accompanying drawings.

DETAILED DESCRIPTION OF THE PREFERRED EMBODIMENTS

The present invention provides an ornamental display receptacle or globe that is filled with a transparent liquid and has at least one figurine disposed therein. In accordance with the invention, the figurine remains substantially fixed in an inertial reference frame when the display globe is subjected to movement.

Figure 1:
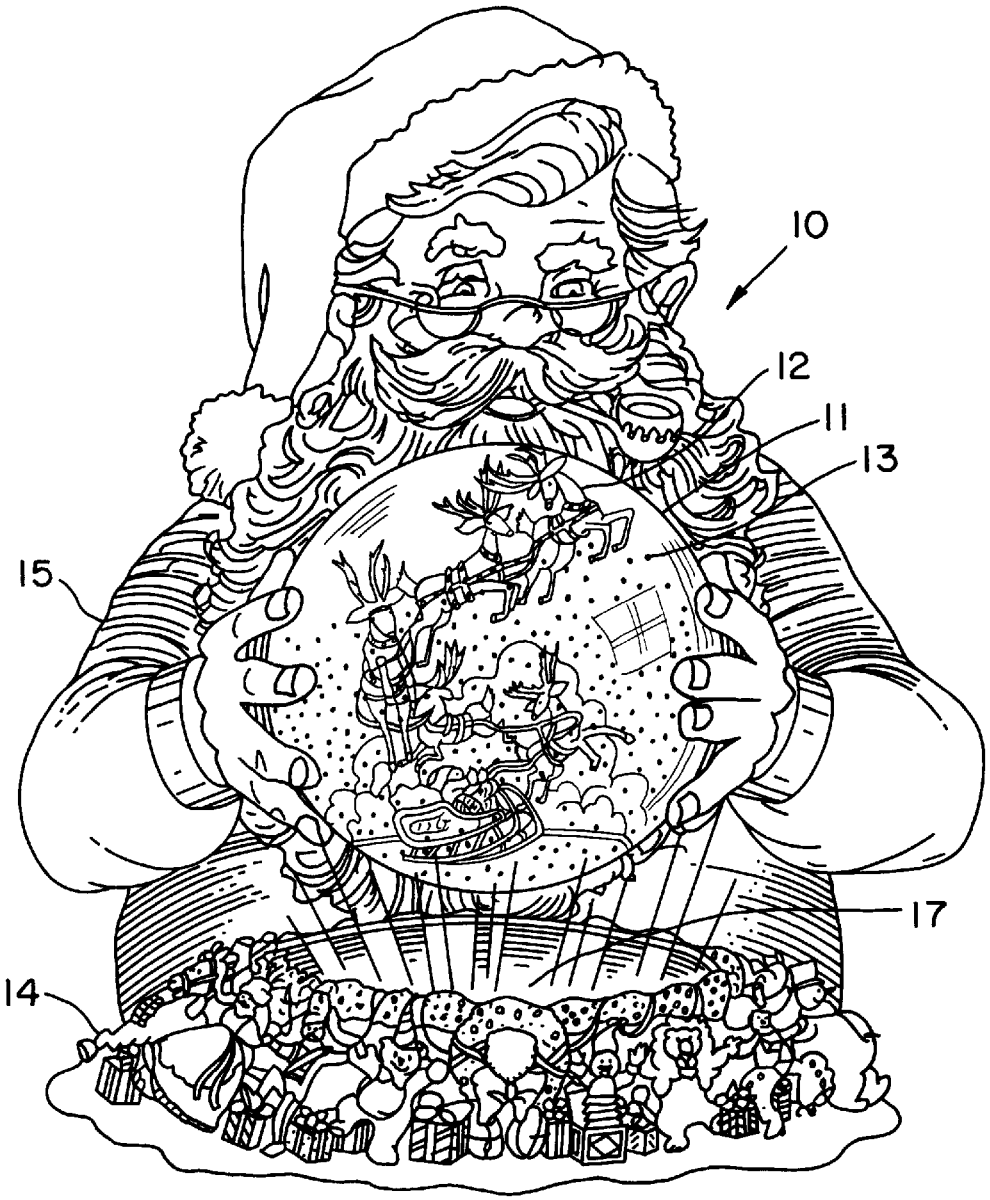
FIG. 1 depicts a perspective view of a first embodiment of the present invention.
Figure 2:
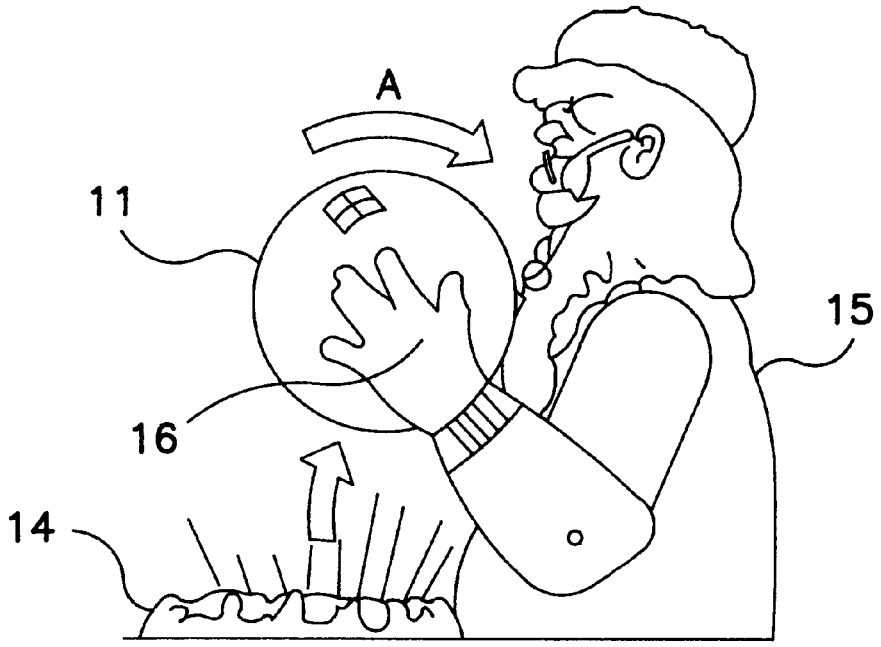
FIG. 2 depicts a side elevational view of the embodiment of the present invention depicted in FIG. 1 showing a display globe in its raised position.

FIG. 1 depicts an ornamental display 10 according to a first embodiment of the present invention. The ornamental display 10 includes a hollow display globe 11, which in this non-limiting example is substantially spherical in shape and is transparent. The display globe 11 is filled with a transparent liquid and has disposed therein a figurine 12 and particulate matter 13. The display globe 11 is rotatably fixed to a displacing mechanism 15 via pins 16 (FIG. 2). The displacing mechanism 15 moves the display globe 11 between a lowered position where the display globe 11 is rested on a base 14, and a raised position where the display globe 11 is lifted off of the base 14.

When the display globe 11 is lifted off of the base 14 (FIG. 2), an illumination device 17 in the base 14 is activated to illuminate the display globe 11 and its contents. As it is lifted from the base 14, the display globe 11 is rotated about the pins 16 (arrow A in FIG. 2). The rotation may be effected manually, may be effected by transmitting a rotational force from a motor or the like to the display globe via the pins 16, or may be imparted to the display globe 11 from the base 14 as the display globe 11 is lifted from the base 14. In any case, the lifting and rotation of the display globe 11 agitates the liquid in the display globe 11 and causes the particulate matter 13 inside the display globe 11 to become randomly suspended in the liquid. In this embodiment, the particulate matter 13 is while and simulates a snow scene when it is suspended in the liquid.

The figurine 12 is weighted so as to be substantially neutrally buoyant within the liquid in the display globe 11. Moreover, the figurine 12 is weighted so as to substantially maintain a preferred orientation in an inertial reference frame even as the display globe 11 is lifted and rotated by the displacing mechanism 15. In this manner, the figurine—a santa sleigh and reindeer in this example—remains in substantially the same position as the display globe moves between the lowered and raised positions. Accordingly, a snow scene can be created while maintaining the orientation of the figurine 12 without having to structurally fix the figurine 12 in place.

Figure 3:
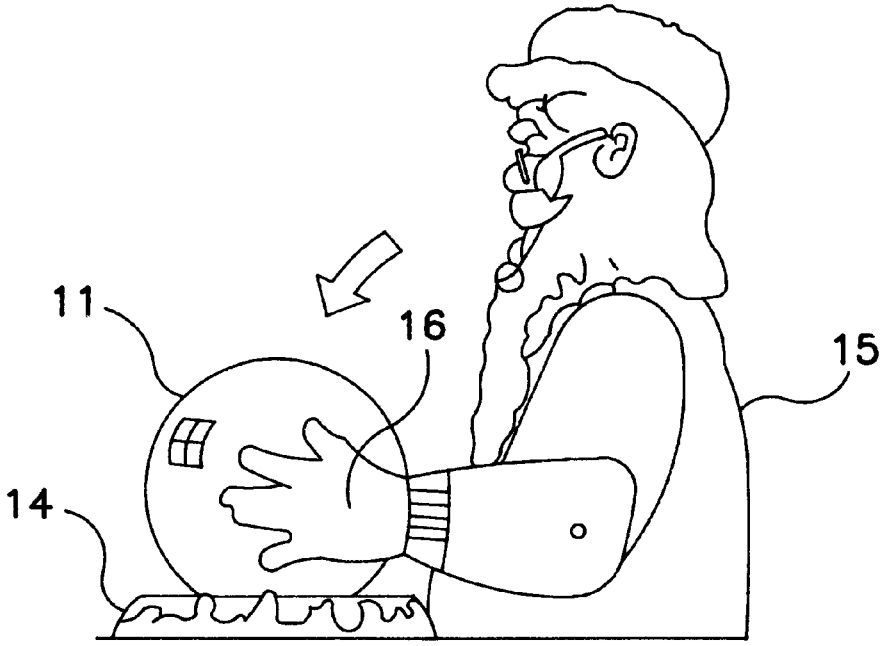
FIG. 3 depicts a side elevational view of the embodiment of the present invention depicted in FIG. 1 showing the display globe in its lowered position.

The displacing mechanism 15 also returns the display globe 11 to its position on the base 14 (FIG. 3). Similarly to when the display globe 11 is lifted from the base 14 and rotated, the substantially neutral buoyancy and weighting of the figurine 12 allow it to substantially maintain its orientation in an inertial reference frame as it is reseated on the base 14 by the displacing mechanism 15. When the display globe 11 is returned to the base 14, the illumination device 17 is turned off. If the display globe 11 remains seated on the base 14 for a sufficient amount of time, the particulate matter 13 settles to the bottom of the display globe 11.

Figure 4:
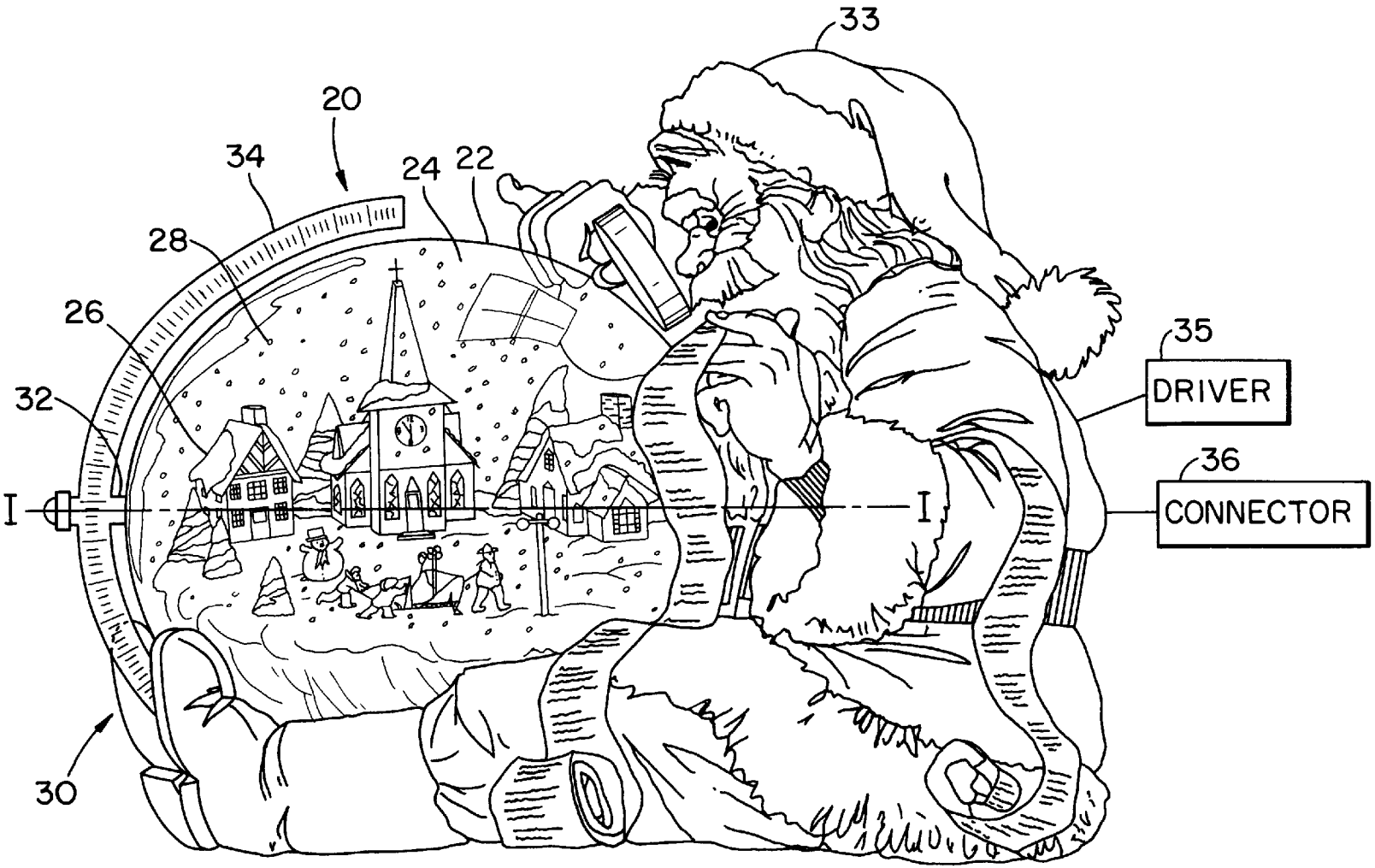
FIG. 4 depicts a perspective view of a second embodiment of the present invention.

FIG. 4 illustrates an ornamental display 20 in accordance with a second embodiment of the present invention. The ornamental display includes a transparent display receptacle or globe 22, which contains a transparent liquid 24, at least one figurine 26 and particulate matter 28.

As in the first embodiment, the figurine 26 is constructed to be substantially neutrally buoyant and to substantially maintain its orientation in an inertial reference frame even as the display globe is subjected to movement. Unlike the first embodiment, however, the display globe in FIG. 4 is not raised and lowered. Instead, the display globe is supported for rotational movement about an axis.

In the embodiment shown in FIG. 4, a support structure 30 is provided for supporting the display globe 22 and permitting rotational movement about a horizontal axis I—I. For this purpose, support structure 30 preferably includes two pivots 32 for rotationally supporting the display globe 22 about the axis I—I.

As will be appreciated, the ornamental display 20 in this embodiment is designed to resemble a rotatable globe, with an oversized Santa Clause 33 peering into the "town" figurine 26. One of the pivots 32 can thus be formed as part of a semi-circular arm 34, while the other pivot extends from within the midsection of Santa Clause and is thus intentionally hidden from view.

In order to rotate the display globe, a driver 35 and a connector 36 are provided, and can be located within the Santa Clause to be hidden from view. The driver and connector are shown in block outline in FIG. 4 because these elements are well known, per se, and a specific type of construction is not critical to carrying out the invention or to a disclosure of the best mode for carrying out the invention.

The driver 35 supplies a driving force and the connector transmits the driving force to rotate the display globe 22 about the pivots 32. It will be appreciated that this embodiment is not limited to any particular structure for providing the rotational force. Thus, whether the driving force is supplied by, e.g., mechanical, electrical, or manual means, is not critical to the present invention.

When the display globe is rotated about an axis, the liquid becomes agitated and causes the particulate matter 28 inside the globe to become randomly suspended in the liquid. As in the first embodiment, the figurine is substantially maintained in a preferred orientation in an inertial reference frame even as the display globe is being rotated. This can be accomplished by properly weighting the figurine as in the first embodiment or, as described below, magnets can be used in place of the weighting or in addition thereto.

Figure 5:
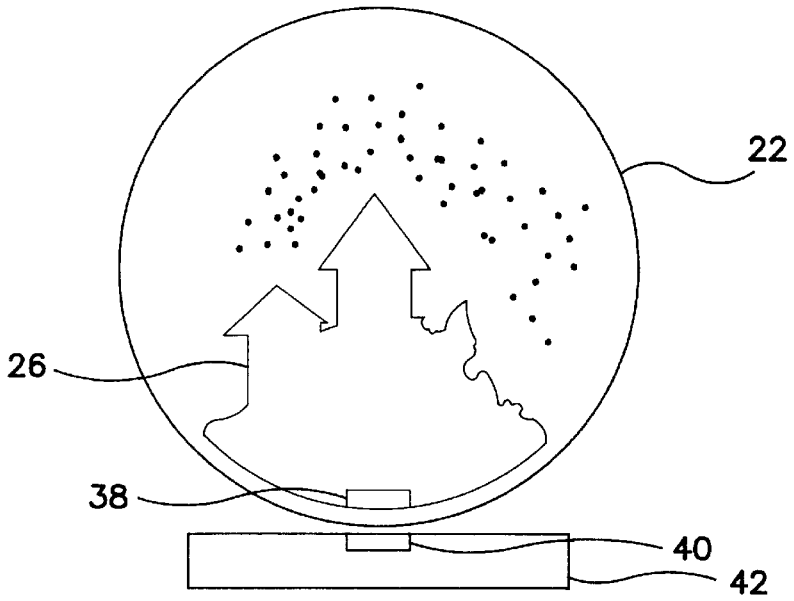
FIG. 5 is a side elevational view of selected components of the second embodiment of the present invention.

FIG. 5 shows how magnets can be used in this manner. The display globe 22 in FIG. 5 includes a figurine 26 which contains a permanent magnet 38. The magnet is preferably fixed to the bottom of the figurine 26. A second permanent magnet 40 is fixed to a stationary base 42 located beneath the display globe 22.

As the display globe rotates, the attraction between magnets 38 and 40 maintains the figurine in its preferred orientation. In the embodiment shown in FIG. 4, the base 42 can be positioned beneath the display globe and between the legs of Santa Clause so as to be hidden from view.

While the display globe 22 is supported for rotational movement about a horizontal axis I-I in the second embodiment, it will be appreciated that the globe can rotate about differently oriented axes without departing from the scope of the invention.

Figure 6:
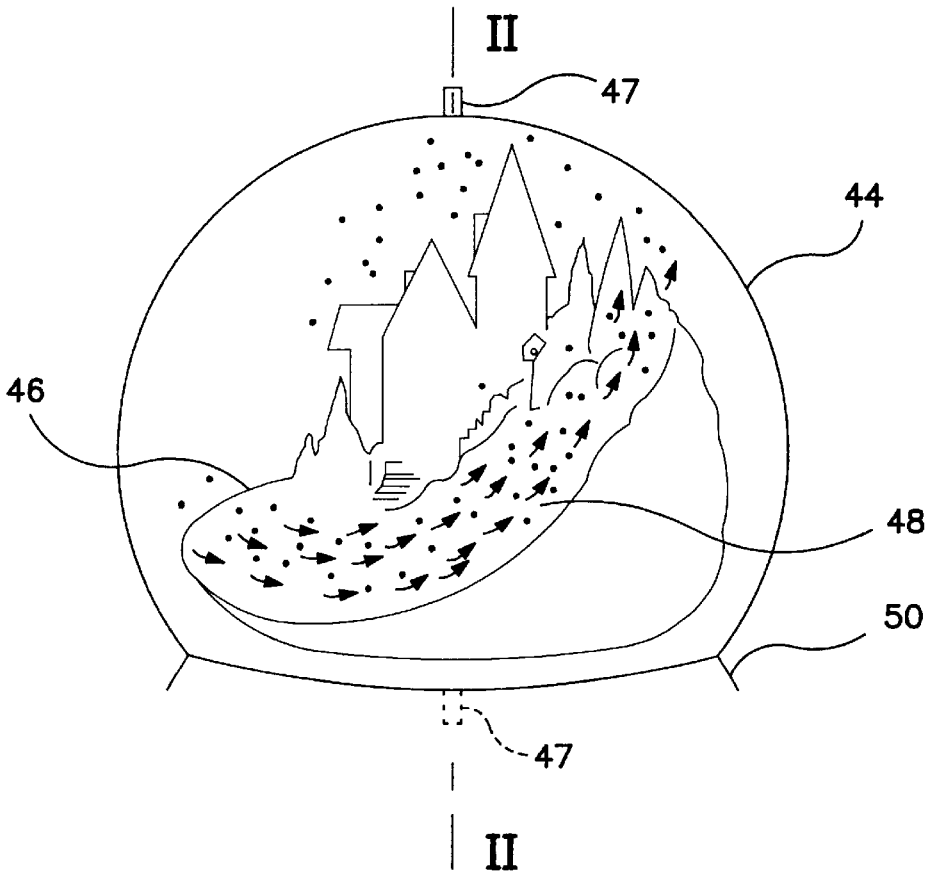
FIG. 6 is a side elevational view illustrating a modification of the second embodiment of the invention.

In FIG. 6, for example, a display globe 44 contains a figurine 16 ideally suited for rotation about pivot points 47 along a vertical axis II—II. When the display globe is rotated in a counterclockwise direction about the axis II—II, an upward sloping portion 48 of the figurine helps to agitate the transparent liquid and particulate matter. With this arrangement, unshown magnets are preferably provided underneath the figurine 46 and in a base 50 for maintaining the figurine in its preferred orientation as the display globe rotates.

Figure 7:
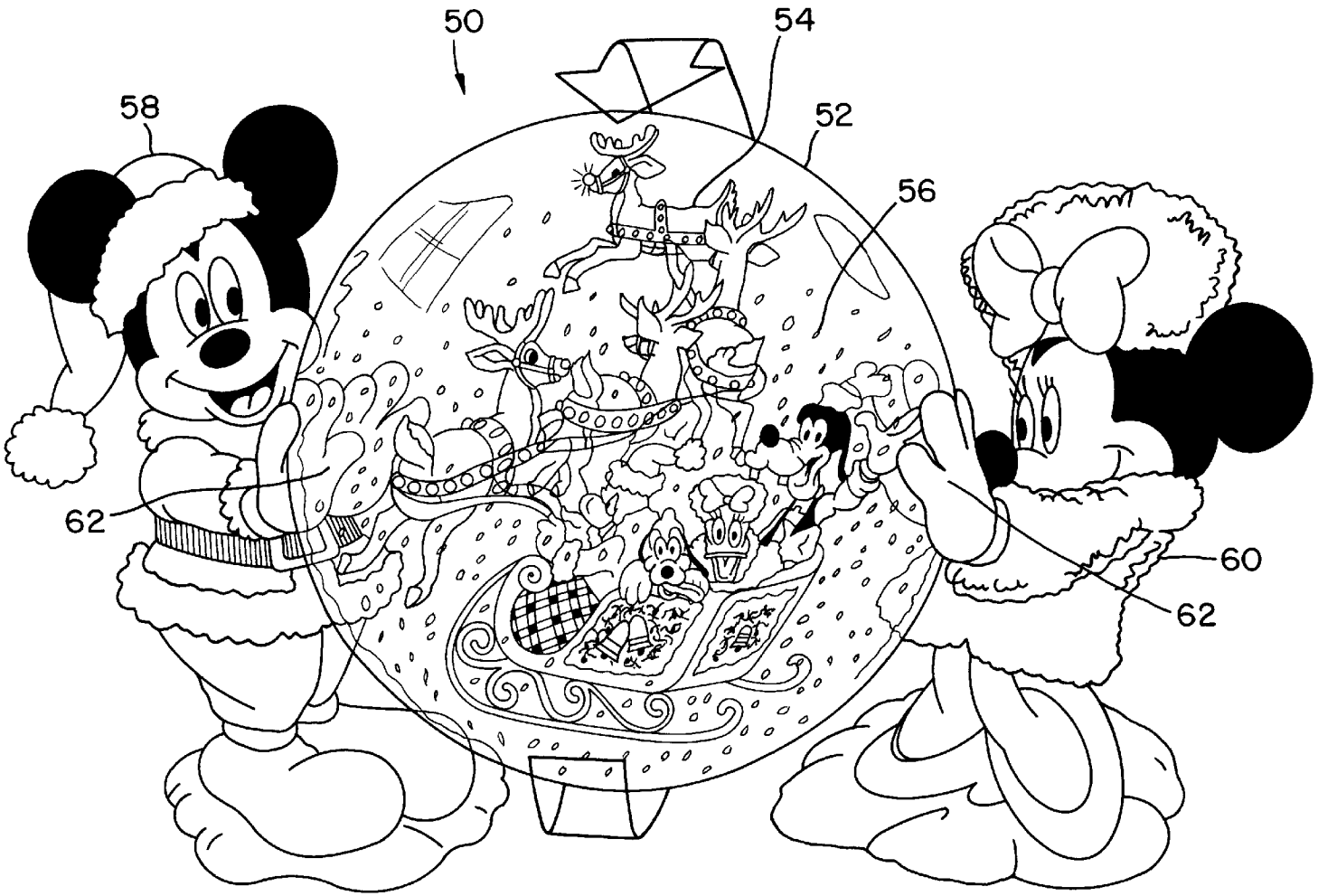
FIG. 7 depicts an alternative arrangement of the second embodiment of the present invention.

FIG. 7 depicts another example of an ornamental display 50 according to the second embodiment of the present invention. As in FIG. 4, the ornamental display 50 includes a display globe 52, which is substantially spherical in shape and transparent, filled with a transparent liquid and containing therein a figurine 54 and particulate matter 56. In this example, the display globe 52 is rotatably fixed to a first supporting member 58 and a second supporting member 60 via pins 62. The display globe 52 may be rotated either manually or by an unshown mechanism about a horizontal axis defined by the pins 62.

As in the other examples, rotation of the display globe 52 agitates the liquid therein to randomly suspend the particulate matter 56 in the liquid. Also, the figurine 54 is neutrally buoyant and constructed, either by weighting, magnets and/or other equivalent means, so as to substantially maintain its orientation in an inertial reference frame even as the display globe 52 is rotated.

Figure 8:
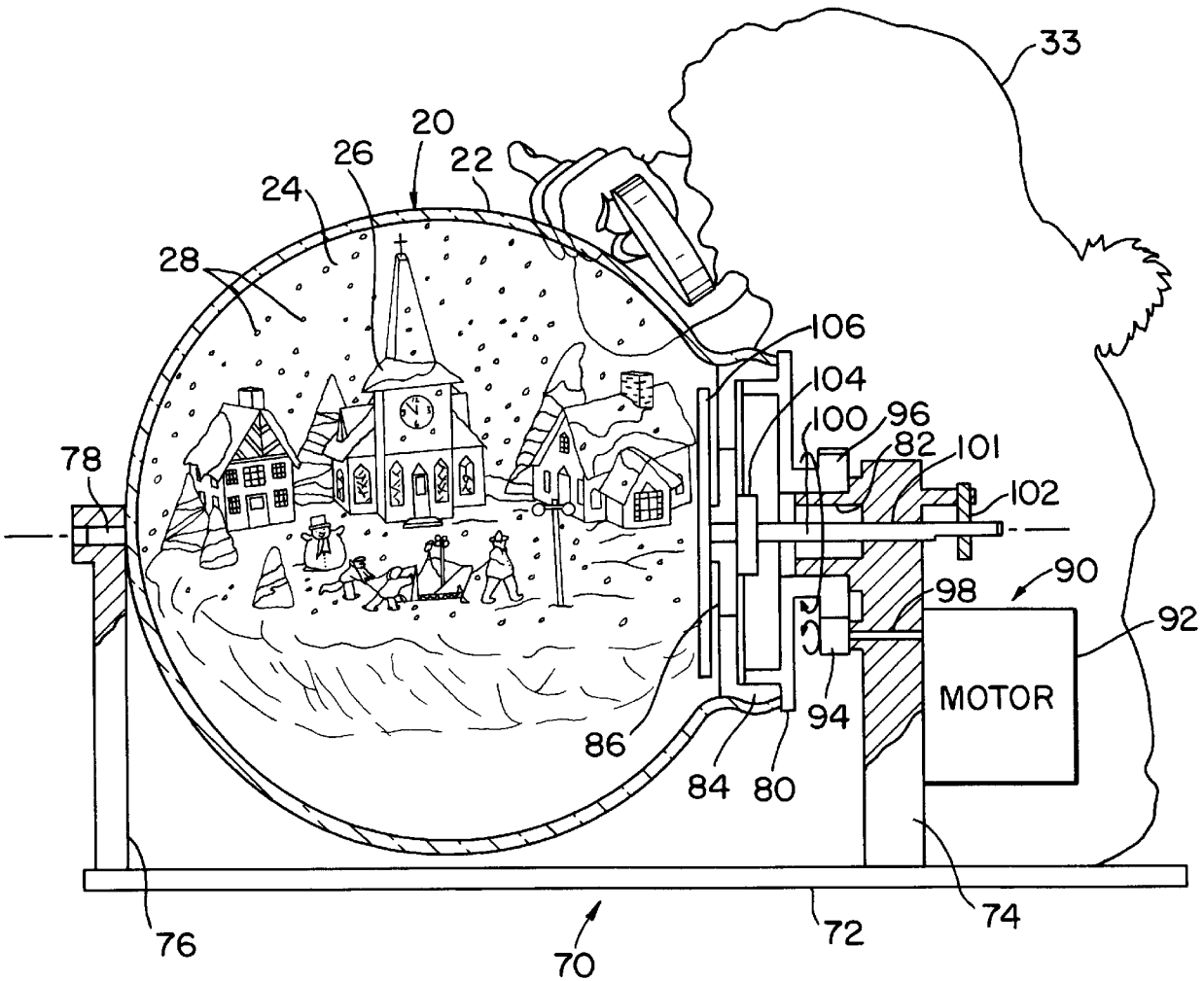
FIG. 8 is a side elevational view, partially in cross-section, illustrating a third embodiment of the invention.

A third embodiment of the invention is shown in FIG. 8. This embodiment includes a number of elements shown in the other embodiments, such as the ornamental display 20 having a transparent display receptacle or globe 22 and containing a transparent liquid 24, at least one figurine 26 (or other type of scenery) and particulate matter 28.

As in the second embodiment shown in FIG. 4, the display globe 20 is supported for rotational movement about an axis I—I, and an animated Santa Clause 33 is provided to add to the visual appeal of the globe while at the same time serving to hide from view some of the components. In this third embodiment, however, the figurine is structurally connected to part of a supporting frame and in this manner is maintained substantially stationary when the display globe is rotated.

In FIG. 8 part of the Santa Claus 33 is cut away to show the structural components of this embodiment. As shown, a main frame 70 includes a platform base 72 and primary 71 and secondary extensions or base members 76 extending upwardly from the platform base to support the display 20 and the other components. The secondary extension 76 receives and supports a rotatable pivot 78 which can be secured to or extending from the display globe 22 (or otherwise structurally connected thereto). The primary extension 74, on the other hand, supports the components for supporting the display globe 22 and the figurine 26 and also for rotating the display globe.

The display globe 22 is formed to be structurally secured to an end cap 80, which itself is rotatably affixed, either directly or indirectly, to a hub 82 rotatable supported by the primary extension 74. A gasket 84 and sealant 86 provide a water tight seal between the display globe and the end cap. As discussed above, the pivot 78 extends from the other side of the display globe opposite from the end cap 80 and defines, along with the rotational center of the end cap, the axis I—I. The pivot and end cap together rotate about the axis I—I to rotate the display globe.

A drive mechanism 90 for rotating the end cap includes a motor 92, drive gear 94 and one or more driven gears 96 for imparting rotational movement from the drive gear to the end cap 80 via the hub 82. FIG. 8 also shows a spindle 98 extending from the motor to the drive gear.

The motor 92 is shown in block outline because it is well known, per se, and a specific type of construction is not critical to carrying out the invention or to a disclosure of the best mode for carrying out this invention. As such, the motor could be electrical, or mechanical, e.g., a wind-up mechanism. Alternatively, a manual mechanism could be provided for rotating the drive gear 94.

A non-rotatable connecting rod 100 extends through a central opening in the end cap and secures the figurine 26. The connecting rod, which is aligned with the rotational axis I—I, is supported within a lateral opening 101 in the primary extension 74 and at its proximal end by an arm 102 that depends from the primary extension. At the distal end of the connecting rod, plates 104 and 106 sandwich the gasket 84 in a manner that allows it to rotate but maintains a watertight fit.

As shown in FIG. 8, the figurine 26 is structurally connected to the plate 104 and thus to the connecting rod. In this way, the figurine is supported in a non-rotational manner and will not move when the display globe is rotated.

The driving and supporting mechanisms are preferably hidden from view by locating these components within, in this example, the animated Santa Clause 33.

In operation, the drive wheel 94 is rotated to turn the end cap and the display globe 22 about the axis I—I. This rotational movement agitates the liquid 24 and causes the particulate matter 28 to move. The figurine, however, remains substantially stationary by virtue of its connection to the non-rotatable connecting rod 10.

Although the display receptacles in the above-described embodiments of the present invention are spherical globes, the present invention it not so limited, and any appropriate receptacle shape may be used. Further, although the foregoing embodiments have only a single figurine within the liquid, of course two or more separate figurines may be provided, as desired.

While the present invention has been described with respect to what is presently considered to be the preferred embodiments, the present invention is not limited to the disclosed embodiments. Rather, the present invention covers various modifications and equivalent arrangements included within the spirit and scope of the appended claims. The scope of the appended claims is to be accorded the broadest interpretation so as to encompass all such modifications and equivalent structures and functions.

What is claimed is:

1. An ornamental display, comprising:

a receptacle filled with a transparent liquid;

a base platform supporting said receptacle;

a figurine disposed inside said receptacle and placed in said transparent liquid so as to have a preferred orientation when said receptacle is subjected to movement; and a supporting mechanism supporting said receptacle for movement, said supporting mechanism including two pivots for supporting said receptacle for movement relative to said base.

2. An ornamental display according to claim 1, further comprising:

a driver providing a drive force; and a connector for transmitting the drive force to rotate said receptacle about a rotational axis.

3. An ornamental display according to claim 1, further comprising a base containing a magnet, with said figurine also containing a magnet and maintaining the preferred orientation by magnetic attraction to said base when said receptacle is moved.

4. An ornamental display according to claim 1, wherein said figurine is weighted to maintain the preferred orientation when said receptacle is moved.

5. An ornamental display according to claim 1, wherein said two pivots rotatably support said receptacle about a horizontal axis.

6. An ornamental display according to claim 1, wherein said two pivots rotatably support said receptacle about a vertical axis.

7. An ornamental display according to claim 6, wherein said figurine includes an upwardly sloping portion for agitating said transparent liquid when said receptacle is rotated.

8. An ornamental display according to claim 1, further comprising:

a first support structurally connected to said receptacle;

a second support structurally connected to said figurine and maintaining said figurine in the preferred orientation when said receptacle is subjected to movement.

9. An ornamental display according to claim 8, further comprising a driving mechanism for moving said receptacle by operating said first support.

10. An ornamental display according to claim 9, wherein said first support supports said receptacle for rotational movement about a rotational axis and said driving mechanism rotates said first support to rotate said receptacle.

11. An ornamental display according to claim 10, wherein said first support includes an end cap sealed to said receptacle and a first base member rotatably supporting said end cap.

12. An ornamental display according to claim 11, further comprising a second base member rotatably supporting said receptacle, with said first and second base members extending from said base platform.

13. An ornamental display according to claim 10 wherein said driving mechanism includes a gear mechanism for rotating said end cap and a motor for driving said gear mechanism.

14. An ornamental display according to claim 8, wherein said second support includes a support member disposed within said receptacle and connected to said figurine.

15. An ornamental display according to claim 14, further comprising a stationary support rod connected to said support member and supported by a base member.

16. An ornamental display according to claim 11, wherein said second support includes a support member disposed within said receptacle and connected to said figurine and a stationary supporting rod connected to said support member and extending through said end cap.

17. An ornamental display according to claim 16, wherein said supporting rod is supported by said first base member.

18. An ornamental display, comprising:

a receptacle filled with a transparent liquid;

a figurine disposed inside said receptacle; and means for supporting said receptacle and subjecting said receptacle to movement said means including two pivots.

* * * * *

UNITED STATES PATENT AND TRADEMARK OFFICE

CERTIFICATE OF CORRECTION

PATENT NO. : 6,052,930

DATED : April 25, 2000

INVENTOR(S): TERRY HERMANSON, ET AL.

It is certified that error appears in the above-identified patent and that said Letters Patent is hereby corrected as shown below:

COLUMN 1:

Line 50, "tile" should read --the--.

COLUMN 3:

Line 30, "while" should read --white--.

COLUMN 5:

Line 44, "rotatable" should read --rotatably--.

COLUMN 8:

Line 25, "movement" should read --movement,--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*